United States Patent [19]

Trouteaud et al.

[11] Patent Number: 4,787,953

[45] Date of Patent: Nov. 29, 1988

[54] APPARATUS FOR LABEL TRANSFER

[75] Inventors: Lee E. Trouteaud, Huber Heights; Fritz F. Treiber, Centerville, both of Ohio

[73] Assignee: Hobart Corporation, Troy, Ohio

[21] Appl. No.: 2,597

[22] Filed: Jan. 12, 1987

[51] Int. Cl.[4] ..... B65C 9/08

[52] U.S. Cl. ..... 156/387; 156/542; 156/571; 156/DIG. 31; 156/DIG. 45; 156/DIG. 47; 156/566; 271/95; 271/107

[58] Field of Search ..... 156/360, 571, 569–570, 156/541–542, DIG. 31, DIG. 45, DIG. 47, 566, 387; 271/107, 95

[56] References Cited

U.S. PATENT DOCUMENTS

| | | | |
|---|---|---|---|
| 3,194,710 | 7/1965 | Stremke et al. | 156/360 |
| 3,264,161 | 8/1966 | Stremke, Jr. | 156/360 |
| 3,428,509 | 2/1969 | Messmer | 156/542 X |
| 3,616,094 | 10/1971 | Navin et al. | 156/571 |
| 4,124,436 | 11/1978 | Pettis, Jr. et al. | 156/542 |
| 4,181,561 | 1/1980 | Seragnoli | 156/571 X |
| 4,390,390 | 6/1983 | Margraf et al. | 156/566 |
| 4,561,921 | 12/1985 | Treiber | 156/297 |

FOREIGN PATENT DOCUMENTS

| | | |
|---|---|---|
| 3317681 | 11/1984 | Fed. Rep. of Germany . |
| 2373453 | 12/1977 | France . |

OTHER PUBLICATIONS

Brochure entitled "Constellation 621—Fully Automatic Price and Weight Labeler for Economical Continuous Output", by Saxer Construction A.G.

*Primary Examiner*—Michael W. Ball
*Assistant Examiner*—Jeff H. Aftergut
*Attorney, Agent, or Firm*—Biebel, French, & Nauman

[57] ABSTRACT

A label transfer arm having a central axis and comprising a socket body with a transfer nozzle rotatably mounted therein engages labels delivered to a label pickup station and transfers them to a label delivery station. An applicator head strips the labels from the transfer arm and moves them along a fixed path from the label delivery station to a package labeling station to apply the labels to packages. Transfer arm guiding rails are positioned on either side of the label transfer arm for engaging an eccentric collar attached to the transfer nozzle to thereby orient the transfer nozzle into a fixed angular orientation about the central axis of the transfer arm when the transfer arm is at the label delivery station. An operator-controllable selector ring is rotatably mounted to the socket body of the arm and is freely rotatable between selected locations defined by detents. The selector ring is coupled to the transfer nozzle by a torsion spring such that an operator can select one of at least two different angular orientations of the transfer nozzle about the central axis of the transfer arm when the arm is located at the lable pickup station. By selecting the angular orientation of the arm at the label pickup station and forcing the arm into a fixed angular orientation at the label delivery station, a label held by the transfer arm is rotated about the central axis of the arm by an angle equal to the difference between the selected angular orientation and the fixed angular orientation.

4 Claims, 3 Drawing Sheets

LABEL POSITION
TOP
A
B
C
30°
100
106B
108
120
120A
122
124
126
128
130
132
134
136
138
140
152
152A
154
170
172
174
180
184
186
190

APPARATUS FOR LABEL TRANSFER

BACKGROUND OF THE INVENTION

The present invention relates generally to a package labeling system, and more particularly, to a method and apparatus for transferring labels from a label source to a label applier such that the angular orientation of labels applied to packages can be conveniently selected by the operator of the labeling system.

Labeling systems in combination with weighing scales are used to automatically weigh and label random weight packaged items, perhaps most commonly packaged meat and produce in supermarkets. In such systems, weight, price-per-unit weight, total price and the like are printed onto labels which are applied to corresponding packages. One prior art system is shown in U.S. Pat. No. 4,561,921, issued Dec. 31, 1985, to Treiber and assigned to the same assignee as the present application.

Typically, packages are conveyed through such systems in a set orientation, for example, with one of the longer edges of each package being the leading edge through the system. Since all labels take the same path from the printer to the packages where they are applied, the labels are oriented the same for each of the packages. While it is possible to feed packages through the machine in other orientations to change the labeling format, the defined orientation is typically preferred since it provides the most stability and is less apt to cause operating problems with the system.

It is often desirable to be able to select the angular orientation of labels applied to packages. For example, the user of a labeling system may wish to arrange packages with either the longer or the shorter package edges being parallel to the front of a display case. If labels are applied in a single orientation by a labeling system, the arangement of packages in a display case is effectively fixed since it is undesirable to have packages oriented such that the information on the labels runs other than upright and horizontally. Some newer display cases have multiple elevations and may be used most efficiently only by selecting label orientations dependent upon where in the case an item is to be displayed.

To overcome these problems, a number of arrangements have been developed in the prior art for controlling the orientation of labels relative to the packages to which they are applied. In U.S. Pat. No. 4,124,436, a label is delivered to an applicator head which takes the form of a vacuum cup. The applicator head engages the label by means of vacuum delivered to the head and is then lowered to press the label onto the surface of a package. If a label is to be applied to a package in a different angular orientation, the applicator head is rotated by means of a cam arrangement, with the amount of rotation being determined by the positioning of a cam follower pin within an elongated cam.

U.S. Pat. No. 3,616,094, discloses another arrangement for altering the angular orientation of labels applied to packages. A vacuum pickup tube, which is rotated through 180° to pick up a label from a machine and move the label to a tranfer position, includes a pickup nozzle mounted for rotary motion at the outer end of the pickup tube, with the pickup nozzle being rotated by means of one of a variety of cam and cam follower arrangements.

While the prior art arrangements do serve to rotate the applicator head and the pickup nozzle of the cited patents, respectively, they tend to be structurally complicated, hence, increasing the expense of a label applier incorporating such structure, while at the same time reducing its reliability.

Accordingly, it is apparent that there is a need for a label applicator which is inexpensive, simple in construction and reliable which permits easy operator selection of the angular orientation of labels applied to packages.

SUMMARY OF THE INVENTION

The problems of the structurally complicated arrangements of the prior art have been overcome in accordance with the present invention wherein a label transfer arm having a central axis is positioned into a first selectable angular orientation about its central axis for label pickup, and then rotated about its central axis to a fixed angular orientation as the arm is moved into a label delivery position where a label applier removes the label from the arm and adheres it to a corresponding package such that the label is rotated by an amount equal to the difference between the selected pickup angular orientation and the fixed delivery angular orientation.

According to one aspect of the present invention, a system for applying labels to individual packages sequentially positioned at a package labeling station includes means for delivering labels to a label pickup station in a fixed orientation, and label applier means movable along a fixed path from a label delivery station to the package labeling station for applying labels to the packages. Label transfer means having a central axis is provided for picking up labels at the pickup station and transferring them to the delivery station. The system is characterized in that it further comprises delivery control meansassociated with the label transfer means for determining a fixed angular orientation of the label transfer means about its central axis when at the label delivery station; and, operator-controllable selector means coupled to the label transfer means for selecting one of at least two different angular orientations of the label transfer means about its central axis when at the label pickup station and for maintaining that selection until a different angular orientation of labels is desired such that labels are applied to packages in an orientation corresponding to a selected orientation.

The label transfer means preferably comprises an arm defining the central axis and having a base end and a distal end adapted to engage a label from the label source, which may be a printer for printing price or information labels or simply a label delivery system for preprinted labels. The label transfer arm is mounted for first rotational motion about its central axis, and second rotational motion about a horizontal axis through its base end, with the second rotational serving to swing the arm between the label pickup position and the label delivery position. The delivery control means comprises guide means positioned on at least one side of the arm between the label pickup and delivery stations and arm rotating means secured to the arm for engaging the guide means as the arm is moved from the pickup station to the delivery station to determine a fixed angular orientation about its central axis when the arm is positioned at the label delivery station.

One of the angular orientations which may be selected by the operator-controllable selector means corresponds to the fixed angular orientation set by the delivery control means. When the fixed angular orientation is selected, the label transfer means directly transfers labels to be applied to packages with no rotation. Normally, at least two different angular orientations are selectable for the labeling system, one, as previously noted, corresponding to no rotation, and one corresponding to a 90° rotation in a preferred direction. For no label rotation or 90° label rotation in one direction, the delivery control means comprises guide means positioned on one side of the label transfer arm, and the selector means sets the arm to the fixed angular orientation and to an angular orientation displaced approximately 90° therefrom toward the guide means. For 90° label rotation in either direction, the guide means is positioned on both sides of the arm, and the selector means sets the arm to the fixed angular orientation and to an angular orientation displaced 90° therefrom in either direcion.

In accordance with one embodiment of the present invention, the transfer arm comprises a socket aligned with the central axis and secured to an axle extending substantially perpendicular to the socket along the horizontal axis, and an elongated nozzle mounted for rotation within the socket. The arm rotating means is secured to the nozzle and the angle selector means comprises a collar rotatably mounted onto the socket and movable between at least two detents, with a torsion spring coupling the collar to the nozzle such that the angular orientation of labels is selected by rotating the collar to one of its detents. Preferably, the torsion spring is open wound to prevent binding when the collar is rotated to select one of the angular orientations other than the fixed orientation defined by the arm when it is positioned at the label delivery station.

According to another aspect of the present invention, a method for transferring labels from a label source to a label applier in a labeling system comprises: rotating a label transfer arm having a central axis about an axis through a base end of the label transfer arm to move a label receiving distal end of the label transfer arm between a label pickup position adjacent the label source and a label delivery position adjacent the label applier; setting the angular orientation of the label transfer arm about its central axis to define a label pickup angle; and conforming the angular orientation of the label transfer arm about its central axis to a fixed angle as the arm is rotated into the label delivery position whereby the arm and any label held thereby are angularly displaced about label transfer arm's central axis by an angle equal to the difference between the label pickup angle and the fixed angle.

It is therefore a primary object of the present invention to provide an improved method and apparatus for transferring labels from a label pickup station to a label delivery station of a labeling system which permits convenient operator selection of the angular orientation of labels applied to packages labeled by the system.

It is another object of the present invention to provide an improved method and apparatus for label transfer from a label pickup position to a label delivery position to permit the selection of the angular orientation of labels applied to packages by a labeling system utilizing the transfer device wherein a label transfer arm is positioned into a first selectable angular orientation about its central axis for label pickup and is then moved to a fixed angular orientation for label delivery to a label applier which adheres the label to a corresponding package in an angular orientation defined by the difference between the first selected angular orientation and the fixed angular orientation.

Other objects and advantages of the invention will be apparent from the following description, the accompanying drawings and the appended claims.

DETAILED DESCRIPTION OF THE INVENTION

While the label transfer method and apparatus of the present invention is generally applicable to automatic labeling systems wherein labels are transferred from a label source to a label applier, they are particularly applicable to the label applicator and method of label application disclosed in U.S. Pat. No. 4,561,921, which is incorporated herein by reference. Accordingly, the present invention will be described as particularly applied to that label applicator.

In the referenced patent, packages are weighed and signals corresponding to the weights are transmitted to a printer which prints labels including such information as the weight, price per unit weight and total price of the corresponding packages. The printed labels have one side coated with a pressure-sensitive adhesive and are delivered to a pickup station with the adhesive coated side facing upwardly and the printed side facing downwardly. A label positioned at the pickup station is engaged by the distal end of a transfer nozzle which is pivoted from the pickup station to a label delivery station by means of a swnnging motion through approximately 180°. The delivery station is positioned immediately below a label applicator head which strips the label from the nozzle and forces the label downwardly into adhesive contact with a package to be labeled.

It is noted that a label application system, such as that disclosed in the referenced patent, incorporating the transfer method and apparatus of the present invention is not to be limited to applying price labels since labels providing information about products and generally referred to as "hi-lite" labels may also be applied. The label source may be a printer for either price or hi-lite labels, or the label source may be a dispensing device for preprinted price labels for fixed weight/fixed price products or preprinted information labels. The present invention is also not limited to the application of labels using a pressuresensitive adhesive, but is equally applicable to any reasonable adhesive, such as heat-activated adhesive.

Figure 1:
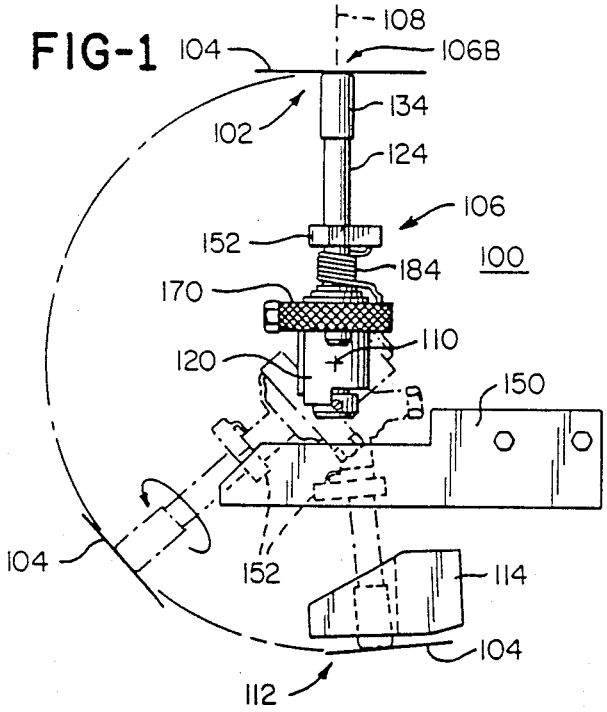
FIG. 1 is an end view of a label transfer device in accordance with the present invention illustrating the manner in which a label is transferred and rotated for application to a package in a selected angular orientation.
Figure 2:
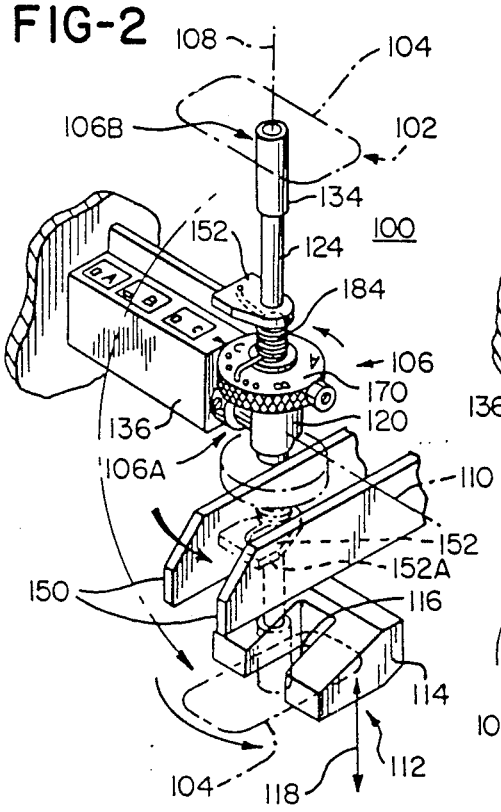
FIGS. 2 and 3 are perspective views showing operation of the label transfer device of the present invention.
Figure 3:
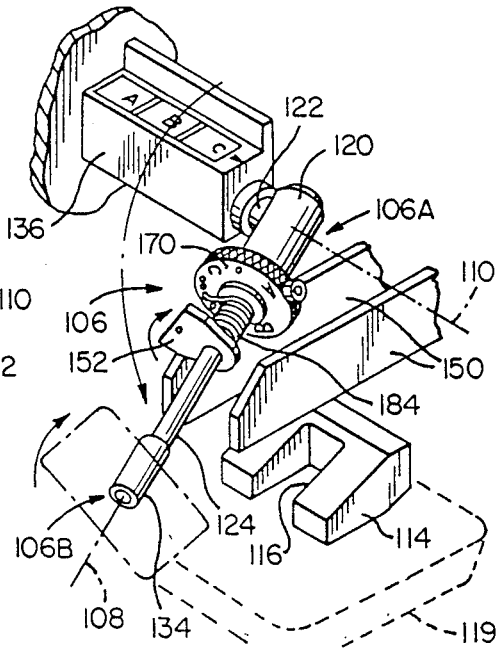

For application to the referenced patent, the label transfer device of the present invention is substituted for the label transfer nozzle of that label applicator, and operated in accordance with the method of the present invention such that the angular orientation of labels may be conveniently selected by the operator of the automatic labeling system. As shown in FIGS. 1–3, a label transfer device 100 is positioned generally beneath a label pickup station 102, which receives labels from a source of labels (not shown), such as a printer or other means for delivering a label 104, to the label pickup station 102.

The label transfer device 100 comprises a label transfer arm 106 having a central axis 108, a base end 106A and a distal end 106B adapted to engage a label at the label pickup position 102 by means of vacuum. The transfer arm 106 is mounted for first rotational motion about its central axis 108 and second rotational motion about a horizontal axis 110 through its base end 106A. The second rotational motion about the axis 110 serves to swing the label transfer arm 106 between the label pickup position 102 and a label delivery position 112. A label applicator head 114 is positioned above the label delivery position 112 and defines a slot 116 into which the label transfer arm 106 is received when the transfer arm 106 is swung into the label delivery position.

Thus, the label delivery arm 106 engages a label 104 at a first position, i.e., the label pickup position 102, and swings the label through approximately 180° to a second position, i.e., the label delivery position 112, immediately below a label applicator head 114 which then moves along a fixed vertical path indicated by an arrow 118 from the label delivery station 112 to a package labeling station (not shown) for applying labels to packages 119 positioned at the package labeling station. The positioning of the packages 119 at the package labeling station is defined by a package side register and a package stop or package pusher as is well known in the art, and hence, will not be described herein.

Figures 4, 5, 6, 7:
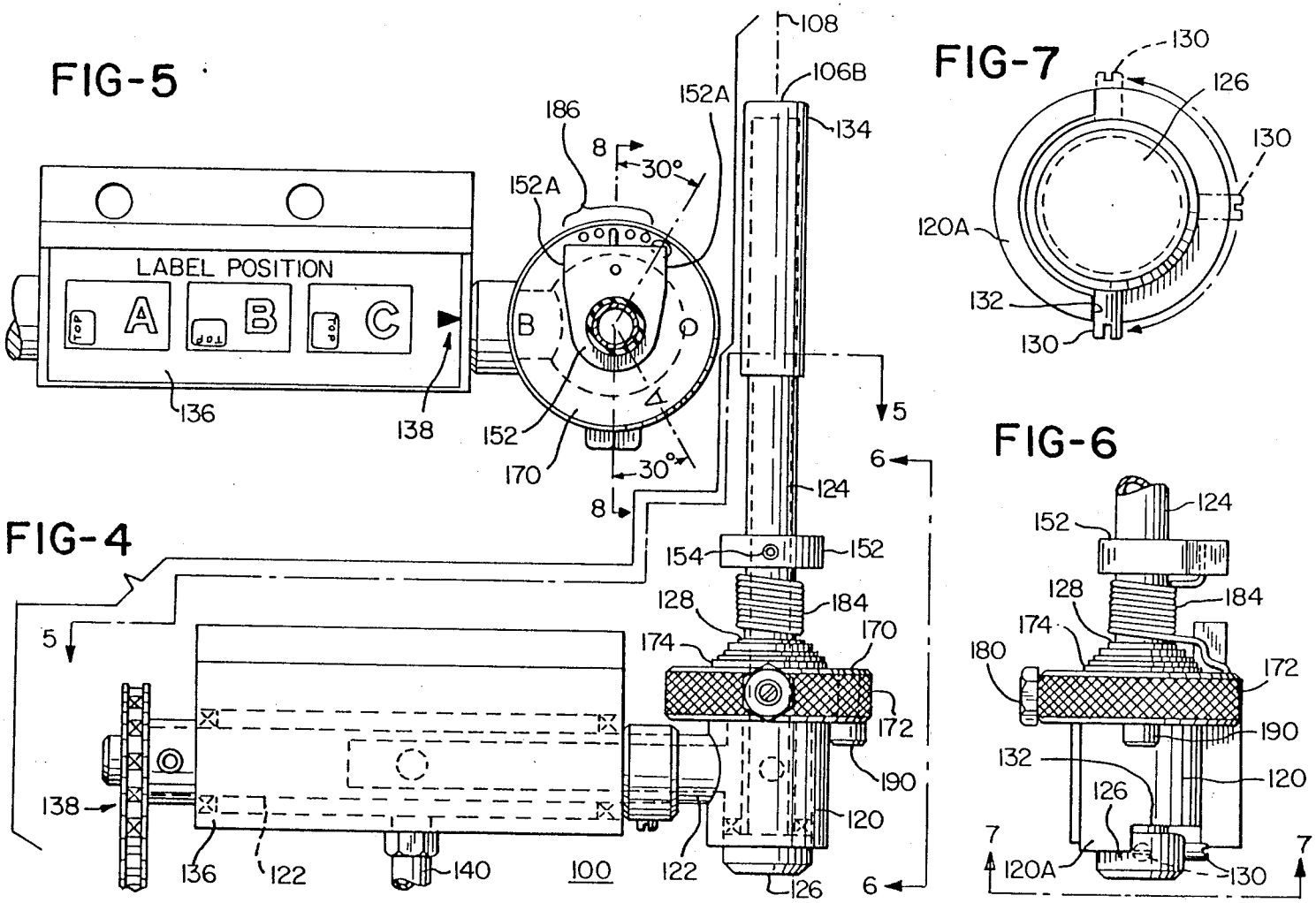
FIG. 4 is a front view of the label transfer device of FIGS. 1–3 set for no label rotation.
FIG. 5 is a partially sectioned top view of the label transfer device of FIG. 4 taken along the line 5—5.
FIG. 6 is an end view of the label transfer device of FIG. 4 viewed along the line 6—6.
FIG. 7 is a bottom view of the label transfer device of FIG. 6 viewed along the line 7—7.

As best shown in FIG. 4, the label transfer arm 106 comprises a socket body 120 which is aligned with the central axis 108 and secured to an axle 122 extending along the horizontal axis 110. The portion of the transfer arm 106 which is rotatable about the axis 108 comprises an elongated nozzle 124 mounted for rotation within the socket body 120. The base end of the elongated nozzle 124 is supported for rotation within the socket body 120 and retained against axial movement relative to the socket body 120 by means of an end cap 126 and a snap ring 128 or other appropriate means.

The end cap 126 is secured to the elongated nozzle 124 by means of an extended set screw 130 which serves to define selected angular pickup orientations of the nozzle 124 by engagement with end faces 132 of a semi-annular extension 120A located at the lower end of the socket 120, see FIGS. 6 and 7. A section of resilient tubing 134 is inserted over and frictionally engages the distal end of the elongated nozzle 124 to define the label engaging end 106B of the label transfer arm 106.

The axle 122 is supported for rotation within a generally rectangular housing 136 and extends therebeyond where it is driven through a chain and sprocket arrangement 138. Vacuum is provided to the nozzle 124 through a conduit 140 which provides access to various passages within the axle 122, the socket 120 and the nozzle 124. It will be apparent that vacuum can be provided to the nozzle 124 in any of a number of various arrangements. The upper face of the housing 136 shows the various label positions which are available for a given label transfer device. The illustrated label positions can readily be selected by an operator of the labeling system, as will be described, by positioning the corresponding letter or other indicia adjacent to an arrow 138 also positioned on the upper surface of the housing 136.

Label delivery control means are associated with the label transfer arm 106 and operable as the arm is rotated from the first or label pickup position 102 to the second or label delivery position 112 for moving the arm 106 to a fixed angular orientation about its central axis 108 when the arm 106 is in the second or label delivery position 112. The fixed angular orientation of the arm 106 is shown in solid lines in FIGS. 4 and 5 and in phantom lines in FIGS. 1 and 2. The delivery control means comprises guide means or rails 150 which are positioned on at least one side of the label transfer arm 106 between the label pickup position 102 and the label delivery position 112, and arm rotating means comprising an eccentric collar 152 which is secured to the nozzle 124 by means of a roll pin 154 or otherwise for engaging the rails 150 as the arm is rotated to deliver a label for application to a package.

The collar 152 is forced to the position shown toward the bottom of FIG. 2 as the label transfer arm 106 is moved to the label delivery position 112 by the eccentric collar 152 engaging and being rotated by the rails 150 such that its sides 152A are substantially parallel to the rails 150. Accordingly, if the eccentric 152 is offset from the position shown in the lower portions of FIGS. 1 and 2, i.e., the fixed angular orientation for the label transfer arm 106 when in the label delivery position 112, the eccentric collar 152 engages the rail 150 toward which it is directed and is forced into the position defining the fixed angular orientation for the label transfer arm 106.

Since the label transfer arm 106 is thus always forced into a fixed angular orientation about its central axis 108 by the delivery control means described, the angular orientation of labels delivered by the label transfer device 100 of the present invention is defined by providing operator-controllable angle selector means coupled to the label transfer arm 106 for selecting one of at least two different angular orientations of the label transfer arm 106 about its central axis 108 when the label transfer arm 106 is positioned at the label pickup station or position 102. By thus selecting or setting the angular orientation of the arm 106 about its central axis 108 when a label is engaged at the label pickup station 102, that label is rotated to the fixed angular orientation as the arm 106 is swung to the label delivery position 112 by the delivery control means to rotate the arm 106, and consequently, the label held at its distal end 106B about the central axis 108 of the arm 106 by an angle equal to the difference between the selected first angular orientation and the fixed angular orientation.

Figure 8:
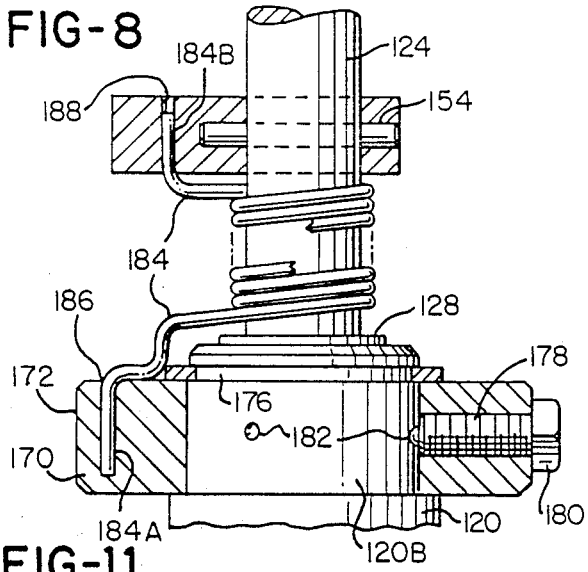
FIG. 8 is a partially sectioned view taken along the section line 8—8 of FIG. 5 showing the adjustment mechanism of the transfer device of the present invention.

In the illustrated embodiment of the label transfer device 100, the angle selector means comprises a collar or selector ring 170 having an outer knurled surface 172 to facilitate rotation of the angle selector ring 170. As best shown in FIG. 8, the socket body 120 has an upper cylindrical extension 120B which is sized to receive the selector ring 170 for rotation about the extension 120B, and hence, relative to the socket body 120. The collar or selector ring 170 is retained on the extension 120B by means of a snap ring 174 which engages an annular groove 176 formed around the upper end of the extension 120B. Desired positions for the selector ring 170 are defined by detents which comprise a spring-operated ball member 178 which is secured to the collar 170 by means of a locking nut 180 such that a spring-operated ball at its distal end engages dimples or recesses 182 formed in the outer surface of the cylindrical extension 120B.

A torsion spring 184 couples the collar or selector ring 170 to the eccentric collar 152 by means of vertical extensions 184A and 184B which engage respectively one of a series of holes 186 formed into the selector ring 170 and a hole 188 formed into the eccentric collar 152. Accordingly, the angular orientation of the nozzle 124 about its central axis 108, when that angular orientation is not restrained to the fixed angular orientation by the delivery control means, i.e., when the label transfer arm 106 is positioned between the label pickup position 102 and the position illustrated in FIG. 3 where the eccentric collar 152 commences engagement with one of the rails 150, is selected by rotating the selector ring 170 to of the detents defined by the recesses 182 in the cylindrical extension 120B of the socket body 120 and the spring-operated ball member 178.

It should be apparent that the selector ring 170 can be freely rotated about the upper extension 120B of the socket body 120 within limits defined by a stop screw 190 which is secured into the underside of the selector ring 170. Further, the elongated nozzle 124 is freely rotatable within the socket body 120 within the restraints defined by the extended set screw 130 and the abutment faces 132 of the semi-annular extension 120A of the socket body 120. By coupling the selector ring 170 to the eccentric collar 152 by means of the torsion spring 184, rotation of the angular selector ring 170 correspondingly rotates the elongated nozzle 124 through the torsional force exerted by the torsion spring 184.

For a new and ideally formed spring 184, the central one of the holes 186 in the selector ring 170 receives the vertical extension 184A and the vertical extension 184B is received within the hole 188 in the eccentric collar 152. The series of holes 186 permits the use of springs which have become deformed due to wear or handling or which have minor variations from the specifications. In any event, as the selector ring 170 is rotated, the eccentric collar 152 is correspondingly rotated such that the nozzle 124 is positioned to a first selected angle for label pickup at the label pickup station 102.

Figure 9:
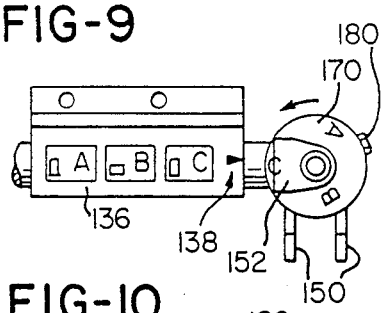
FIGS. 9 and 10 show the ease of selecting the angular orientation of a label which is transferred by the label transferring device of the present invention.
Figure 10:
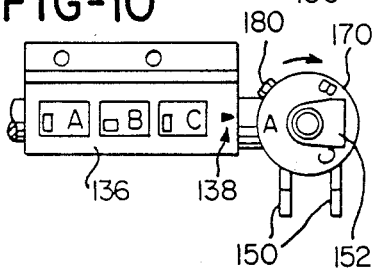

In the illustrated embodiment, three pickup positions A, B and C are defined, with B being the neutral pickup position wherein the nozzle 124 is not rotated as it is swung from the label pickup position 102 to the label delivery position 112. Positions A and C serve to rotate the nozzle 124 90° in either direction from the fixed angular orientation (setting B) defined by the delivery control means as described above. As shown in FIGS. 9 and 10, the operator may select the desired angular orientation for a label by rotating the selector ring 170 such that the corresponding letter is adjacent the arrow 138. These positions are stable detent positions of the selector ring 170 as defined by the spring-operated ball member 178 and the corresponding recesses 182 in the cylindrical extension 120B of the socket body 120.

To ensure that the eccentric collar 152, and in turn the nozzle 124, is rotated fully 90° upon selection of either position A or position C, positions A and C are located approximately 30° beyond the desired 90° locations. It is noted, however, that the nozzle 124 and the eccentric collar 152 which is securely affixed thereto by means of the set screw 154 are limited to 90° rotation in either direction by means of the elongated set screw 130 in the end cap 126 which is secured to the bottom end of the nozzle 124, with the elongated set screw 130 engaging the abutment faces 132 of the semi-annular extension 120A of the socket body 120. It is apparent that by locating the detents defining the positions A and C approximately 30° beyond the desired locations as defined by the elongated set screw 130, the torsion spring 184 is biased to absorb the additional rotation. Further, the spring-operated ball member 178 is sufficiently strong that it will retain the positions A and C against the counterrotational forces exerted by the biasing of the spring 184 beyond the desired positions defined by the elongated set screw 130.

Figure 11:
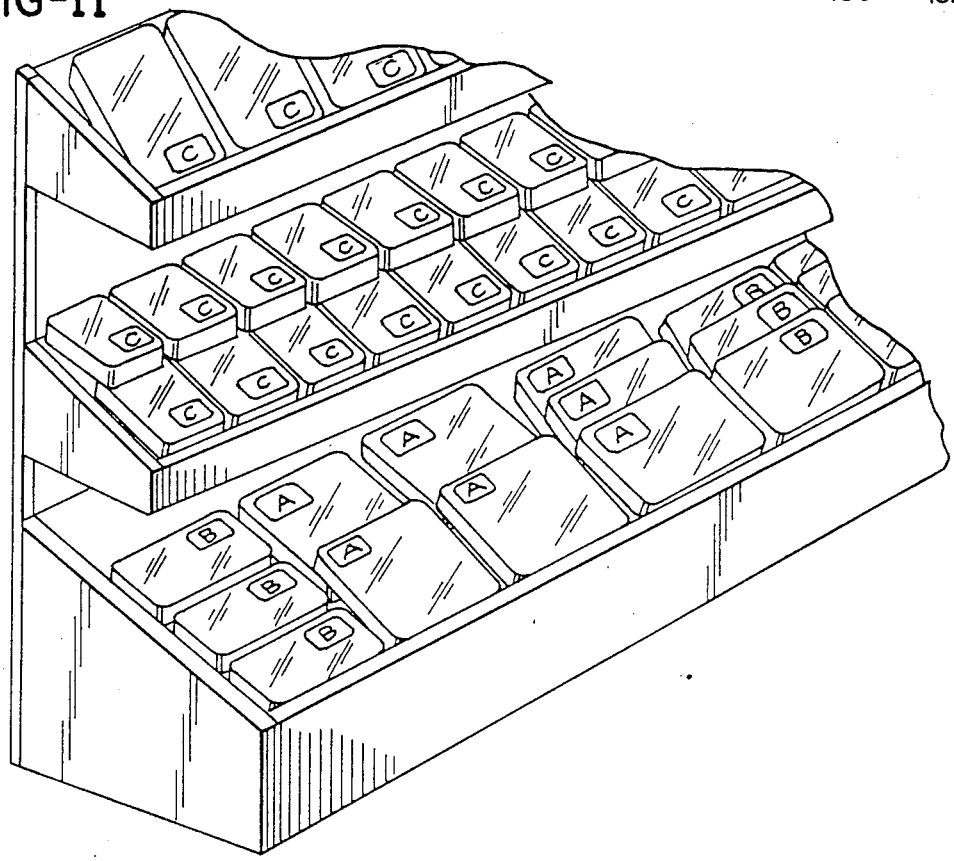
FIG. 11 illustrates a multiple elevation display case showing packages having various label orientations.

FIG. 11 shows a multiple elevation display case illustrating the placement of packages having the three designated label orientations provided in accordance with the illustrative embodiment of the label transfer device 100 of the present invention. While the three designations B, A and C correspond to no rotation and rotations of 90° in either direction, respectively, it is apparent that effectively any angular orientation and any reasonable number of angular orientations could be provided if desirable for a given application. This could be done by formation of the semi-annular extension 120A of the socket body 120 to define the end angular orientations and/or the provision of any additional angular orientations by means of providing additional detents for the selector ring 170 by forming additional dimples or recesses 182 into the cylindrical extension 120B of the socket body 120.

In accordance with the illustrative embodiment, the angular orientations of labels applied by a labeling system incorporating the label transfer device 100 of the present invention may be oriented into one of the three positions A, B and C as defined in FIG. 5. For position B, the selector ring 170 is positioned as shown in FIGS. 4 and 5, i.e., with the letter B aligned with the arrow 138. For this position, the selected angular orientation of the label transfer arm 106, when in the label pickup position 102, corresponds to the fixed angular orientation which is set by the delivery control means as previously described. Accordingly, for label position B, there is no rotation of the label about the central axis 108.

If the selector ring 170 is moved to select label position A or C as shown in FIGS. 10 and 9, respectively, the eccentric collar 152 is biased by means of the torsion spring 184 to a position 90° away from the position shown in FIGS. 4 and 5 which is defined by the elongated set screw 130 and the semiannular extension 120A of the socket body 120. In these orientations, the label pickup position is displaced by 90° from the "no rotation" pickup position defined by label position B such that the label 104 is picked up at a selected orientation 90° from the fixed orientation defined by the delivery control means. As shown in FIGS. 2 and 3, as the label transfer arm 106 is swung from the label pickup position 102 to the label delivery position 112, the eccentric collar 152 engages the corresponding one of the rails 150 and rotates the label transfer arm 106 to the fixed angular orientation about its central axis 108 as defined by the delivery control means. The label is then applied to the package by the label applier head 114.

It may be desirable in certain applications to provide only two label orientations, for example, orientations B and C, such that one of the rails 150 could be eliminated. However, it may be desirable to provide both rails 150 even for a two position label applicator to more quickly stabilize the label transfer arm 106 in the fixed angular orientation which is required when the label transfer arm 106 is positioned at the label delivery position 112.

In view of the above description of the label transfer device and method in accordance with the present invention, various alterations and additional will be apparent to those skilled in the art. For example, the label transfer arm 106 could be controlled to select one of two or more angular orientations for label pickup and the fixed angular orientation for label delivery by means of electrically operated solenoids or the like. The illustrated embodiment is believed to be the most simple and inexpensive to perform the method in accordance with the present invention; however, such alterations and alternate embodiments are considered to be within the scope of the present invention.

Accordingly, while the method herein described and the form of apparatus for carrying this method into effect constitute preferred embodiments of this invention, it is to be understood that the invention is not limited to this precise method and form of apparatus, and that changes may be made in either without departing from the scope of the invention which is defined in the appended claims.

What is claimed is:

1. In a labeling system having a source of labels each having a printed side and an adhesive side, and a label applier for applying the labels to packages, a label transfer device for receiving labels having the adhesive sides up from the label source and transferring the labels to the label applier with the adhesive sides down and having one of at least two selectable angular orientations relative to the packages, said label transfer device comprising:

a label transfer arm having a central axis, a base end and a distal end adapted to engage a label from the label source by means of vacuum, said transfer arm being mounted for first rotational motion about its central axis and second rotational motion about a horizontal axis through its base end, said second rotational motion swinging said arm between a first label pickup position adjacent the label source and a second label delivery position adjacent the label applier;

angle selector means for selectively setting said arm to a fixed angular orientation about its central axis when in said first label pickup position or to an angular orientation displaced 90 degrees in either direction from said fixed orientation;

guide means positioned on both sides of the path of said arm as it is rotated from said first position to said second position; and arm rotation means secured to said arm for engaging said guide means as said arm is rotated from said first position to said second position and moving said arm to said fixed angular orientation whereby said label transfer device is able to provide no label rotation or 90 degrees of label rotation in either direction.

2. In a labeling system having a source of labels each having a printed side and an adhesive side, and a label applier for applying the labels to packages, a label transfer device for receiving labels haivng the adhesive sides up from the label source and transferring the labels to the label applier with the adhesive sides down and having one of at least two selectable angular orientations relative to the packages, said label transfer device comprising:

a label transfer arm having a central axis, a base end and a distal end adapted to engage a label from the label source by means of vacuum, siad transfer arm being mounted for first rotational motion about its central axis and second rotational motion about a horizontal axis through its base end, said second horizontal motion swinging said arm between a first label pickup position adjacent the label source and a second label delivery position adjacent the label applier;

angle selector means for setting the angular orientation of said arm about its central axis when in said first label pickup position;

guide means positioned on at least one side of said arm as it is rotated from said first position to said second position; and arm rotating means secured to said arm for engaging said guide means as said arm is rotated from said first position to said second position, whereby said arm is set to a selected first angular orientation about its central axis for label pickup at said first position, and is rotated to a fixed angular orientation of said arm swings to said second position for label delivery to rotate said label about the central axis of said arm by an angle equal to the difference between said first angular orientation and said fixed angular orientation;

said transfer arm comprising a socket aligned with said central axis and secured to an axle extending along said horizontal axis and an elongated nozzle mounted for rotation within said socket;

said arm rotating means being secured to said nozzle; and said angle selector means comprising a collar rotatably mounted onto said socket and movable between at least two detents and a torsion spring coupling said collar to said nozzle whereby the angular orientation of labels is selected by rotating said collar to one of said detents.

3. A label transfer device as claimed in claim 2 wherein said torsion spring is open wound.

4. A label transfer device as claimed in claim 3 wherein said source of labels comprises a printer.

* * * * *